US005742016A

United States Patent [19]

Rolff

[11] Patent Number: 5,742,016

[45] Date of Patent: Apr. 21, 1998

[54] ELECTRICAL GAS-BLAST SWITCH

[75] Inventor: Klaus-Peter Rolff, Berlin, Germany

[73] Assignee: Siemens Aktiengesellschaft, Munich, Germany

[21] Appl. No.: 646,369

[22] PCT Filed: Oct. 27, 1994

[86] PCT No.: PCT/DE94/01298

§ 371 Date: Jul. 9, 1996

§ 102(e) Date: Jul. 9, 1996

[87] PCT Pub. No.: WO95/14303

PCT Pub. Date: May 26, 1995

[30] Foreign Application Priority Data

Nov. 19, 1993 [DE] Germany ..... 43 39 923.1

[51] Int. Cl.[6] ..... H01H 33/88

[52] U.S. Cl. ..... 218/61; 218/60

[58] Field of Search ..... 218/13, 22, 23–28, 218/43, 48–51, 56, 57, 59–61, 63, 65, 68, 72, 76, 78, 84, 85, 87, 88

[56] References Cited

U.S. PATENT DOCUMENTS

| | | | |
|---|---|---|---|
| 3,549,842 | 12/1970 | Fischer | 200/148 |
| 3,745,281 | 7/1973 | Yoshioka | 200/148 R |
| 3,872,272 | 3/1975 | Yoshioka | 200/148 A |
| 4,041,263 | 8/1977 | Noeske | 200/148 A |
| 4,209,679 | 6/1980 | Koppl et al. | 200/148 A |
| 4,511,775 | 4/1985 | Korner et al. | 200/148 |
| 5,285,036 | 2/1994 | Lorenz | 200/148 |

FOREIGN PATENT DOCUMENTS

| | | | |
|---|---|---|---|
| 26 18 087 | 2/1977 | Germany | H01H 33/91 |
| 31 41 324 | 3/1983 | Germany | H01H 33/915 |
| 32 31 169 | 2/1984 | Germany | H01H 33/915 |
| 40 10 006 | 10/1991 | Germany | H01H 33/91 |
| 40 10 007 | 10/1991 | Germany | H01H 33/91 |

*Primary Examiner*—Michael L. Gellner
*Assistant Examiner*—Michael A. Frienhofer
*Attorney, Agent, or Firm*—Kenyon & Kenyon

[57] ABSTRACT

In a gas-blast switch with a compression device with a compression piston and a compression cylinder, at least one of which can be moved by the drive during the cut-off process, starting from a cut-in position, reducing a compression space delimited by them, the initial quenching gas pressure is increased in that the compression piston is moved toward the compression cylinder in advance. In order to take advantage of the magnetic effect of the break current, an armature which can be moved by the magnetic field of a stator which can be excited by the break current is provided, producing a pressure influence causing the advance movement of the compression piston via a compression chamber.

7 Claims, 2 Drawing Sheets

ELECTRICAL GAS-BLAST SWITCH

FIELD OF THE INVENTION

The present invention relates to an electrical gas-blast switch.

BACKGROUND INFORMATION

An electrical gas-blast switch is shown in German Patent Application No. 32 31 169 in which the magnetic effect of the break current is utilized for compressing a quenching gas. However, the quenching gas compressed in such a way is released at a disadvantageous point in time.

In another electrical gas-blast switch shown in German Patent Application No. 40 10 007, at least one fixed contact piece can be linked with a connector, as necessary, via a switching piece which can be moved by a drive. A compression device with a compression piston and a compression cylinder surrounds the arc space which exists between the contact piece and the connector piece. During the cut-off process, the compression piston is moved relative to the compression cylinder, causing the compression space delimited by them to be reduced. In order to utilize the magnetic effect of the break current to support the drive, an armature is linked with the compression piston via a rod. After the compression cylinder has been moved a certain path distance during the cut-off process, in the sense of contact separation, the armature, which is structured as part of the piston rod and consists of ferromagnetic material, gets into the region of influence of the magnetic field of a stator excited by the break current. At this moment, the compression piston is accelerated counter to the movement of the compression cylinder, and causes an increase in the quenching gas pressure during the cut-off process.

A variation of a drive support by means of the magnetic effect of the break current, as described in German Patent Application No. 40 10 006, contains at least one armature attached to the compression cylinder, which dips into a slit of a yoke during the cut-off process, after a partial movement distance of the compression cylinder, and supports the compression cylinder movement from this time on.

In another gas-blast switch shown in German Patent No. 31 41 324, the rated current flows via the compression cylinder. Only after a partial movement of the compression cylinder during the cut-off process does the break current commutate to a gradient coil, which produces movement of a ring piston which directly supports the arc blasting.

SUMMARY OF THE INVENTION

The present invention provides a gas-blast switch which includes at least one fixed contact piece and a switching piece which can be moved by a drive. The electrical gas-blast switch also includes a compression device with a compression piston and a compression cylinder, at least one of which can be moved by the drive during the cut-off process, where the drive starts from a cut-in position, reducing a compression space delimited by the compression piston and the compression cylinder. The gas-blast switch also includes an armature which can be moved axially by the magnetic field of a stator which can be excited by the break current, where a drive piston which delimits a compression chamber is mechanically linked with the armature, and where the armature and the stator are arranged in such a way that the magnetic field already causes the armature to move in the cut-in position of the compression device.

An object of the present invention is to provide a gas-blast switch which allows blasting of the arc at a comparatively slight stroke of the compression cylinder, with a relatively high initial quenching pressure.

The aforementioned object is accomplished according to the present invention in that the side of the compression piston facing away from the compression space has the compression chamber pressure acting on it, so that a compression chamber pressure increase causes a movement of the compression piston in the direction toward the compression cylinder.

An advantage of the present invention is that a short-circuit or break current which occurs produces the axial movement of the armature before the switch is triggered in the cut-in position of the compression device. This causes a significant pressure to build up in the compression chamber which acts on the side of the compression system facing away from the compression space. The compression piston therefore moves toward the compression cylinder, so that the compression space delimited thereby is reduced in advance. As a result, a significantly increased initial pressure builds up in the compression space before the drive starts the actual cut-off process. The increased initial pressure of the quenching gas has an advantageous effect on blasting of the arc which ignites during the cut-off process. The stroke of the compression cylinder can therefore be designed to be shorter. Depending on the design of the compression chamber, the excess pressure produced in the chamber can be so high that the subsequent cut-off movement of the compression cylinder is supported.

To increase the magnetic flux and the utilization of the magnetic effect of the break current, another embodiment of the present invention provides that the stator is a coil. A preferred embodiment of the present invention comprises a coil which includes a segment of a connector piece and a wall having a radial slit wound like a screw passing through it.

DETAILED DESCRIPTION

Figure 1:
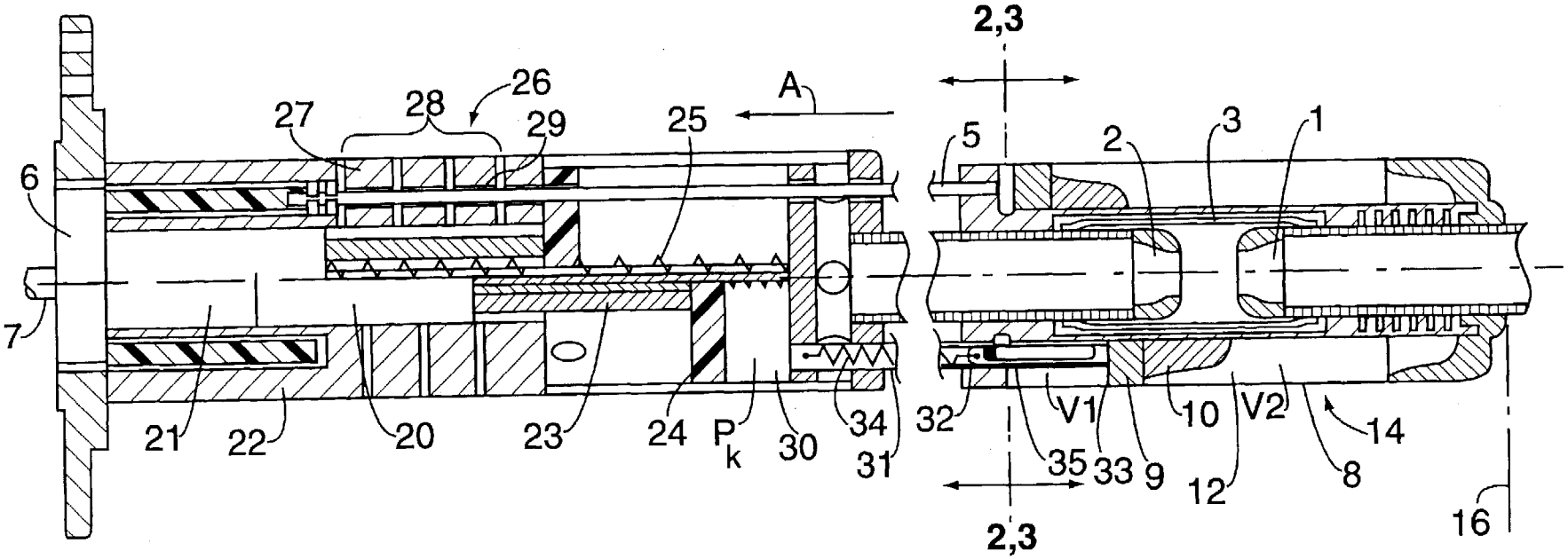
FIG. 1 is a cross-section view of a gas-blast switch according to the present invention.

The gas-blast switch according to the present invention as shown in FIG. 1 has a fixed contact piece 1 and a connector piece 2, the connector piece 2 positioned opposite the fixed contact piece 1. The fixed contact piece 1 and the connector piece 2 can be electrically connected via a movable switching piece 3. The movable switching piece 3 is linked with a mechanical drive 7 (not shown in detail) via a switching rod 5 and a drive fork 6. The movable connector piece 3 is rigidly connected with a compression cylinder 8. The compression cylinder 8, together with an axially movable compression piston 9 with a filler element 10 arranged on it, delimits a compression space 12 of the compression device 14. The compression cylinder 8 is also connected with the mechanical drive 7, via the switching rod 5. FIG. 1 illustrates the compression cylinder 8 in the cut-in position 16, in which the switching piece 3 is in a position connecting the fixed contact piece 1 with the connector piece 2.

In the rear region of the gas-blast switch, there is an armature 20, which is arranged in the interior 21 of the rear continuation 22 of the connector piece 2, so that it can slide axially, and which is insulated. The armature 20 consists of a ferromagnetic material and is linked with a drive piston 24 via a connecting rod 23. A positioning spring 25 ensures that the armature 20 stays in a rest position, shown above the center line in FIG. 1, if there are no other forces acting on the armature 20. The continuation 22 of the connector piece 2 is formed as a stator 26 in the form of a coil 27, so that a segment 28 of the connector piece 22 has a continuous radial slit 29 wound like a screw passing through its wall. The windings are well insulated from one another electrically.

Figure 6:
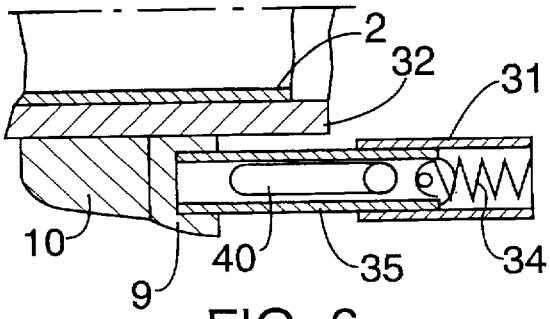
FIG. 6 shows the cross-section of the gas-blast switch along VI—VI as shown in FIG. 3.

The drive piston 24 is adjoined by a compression chamber 30, which is communicatively connected with a volume V1 between a guide piece 32 and the side 33 of the compression piston 9 facing away from the compression space 12, via an overflow pipe 31. In the overflow pipe 31, a tension spring 34 is arranged which is attached to the open end of the overflow pipe 31 facing toward the compression chamber 30 at its one end, and which is fixed in place on a stop guide 35 (as shown in FIG. 6) at its other end. The tension spring 34 serves as a positioning spring in order to bring the compression piston into the rest position shown in the top half of FIG. 1.

In the case of a load current which significantly exceeds the rated current (short-circuit current or break current), the stator 26 produces a magnetic field which is sufficiently strong to draw the armature 20, which is arranged adjacent to it, into the coil 27, counter to the force of the spring 25 (bottom half of FIG. 1, with the cross-sectional plane offset by 90° relative to the top half of FIG. 1). Because of the related movement of the drive piston 24, the compression chamber 30 is significantly reduced in size, so that the compression chamber pressure $p_k$ increases significantly. The pressure increase in the compression chamber acts on the side 33 of the axially movable compression piston 9 via the overflow pipe 31. The axially movable compression piston 9 moves toward the compression cylinder 8, causing the volume V1 to be increased, and at the same time, the compression space 12 to be reduced to the volume V2. This results in a significant pressure increase in the compression space 12. If a maximum permissible rated current is exceeded (short-circuit current or break current), the switch subsequently opens, and the mechanical drive 7 moves the compression cylinder 8 in the direction of the arrow A. When the movable switching piece 3 moves away from the fixed contact piece 1, an arc ignites between the fixed contact piece 1 and the movable switching piece 3. The arc is already strongly blasted at the beginning, because of the increased initial pressure of the quenching gas in the volume V2, which has an advantageous effect on the quenching process. Because of the initial quenching gas pressure, which was increased in advance by taking advantage of the excess current energy, and because of the axially movable compression piston 9, which was moved in advance, the compression cylinder stroke to be produced by the mechanical drive 7 can be reduced accordingly. As shown in FIG. 6, the advance movement of the compression cylinder 8 can be delimited by a longitudinal groove 40 as a stop guide. The axially movable compression piston 9 can be additionally locked in place in the advanced position. If the compression chamber 30 is designed accordingly, the pressure in the volume V1 can still be high enough, even when the axially movable compression piston 9 is moved forward, so that the subsequent compression cylinder movement is supported by the pressure which acts on the subsequent end disk 42 (FIG. 2) of the guide piece 32.

Figure 2:
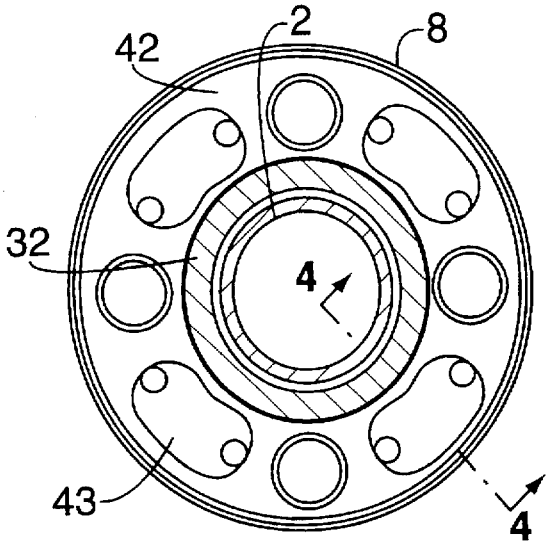
FIG. 2 shows the cross-section of the gas-blast switch along II—II as shown in FIG. 1.
Figure 4:
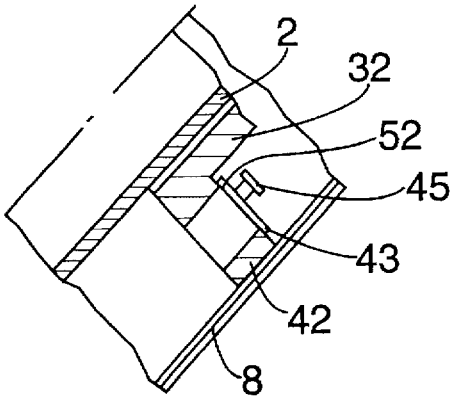
FIG. 4 shows the cross-section of the gas-blast switch along IV—IV as shown in FIG. 2.
Figure 5:
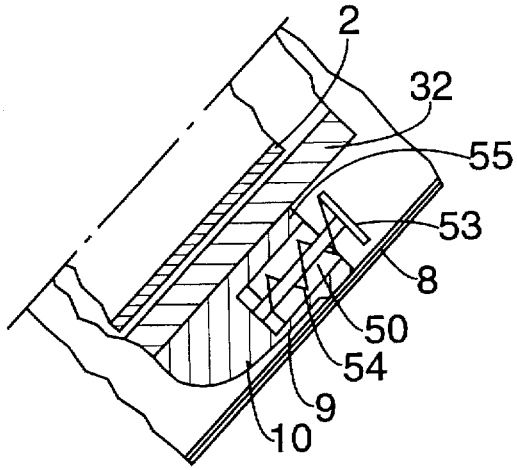
FIG. 5 shows the cross-section of the gas-blast switch along V—V as shown in FIG. 3.
Figure 3:
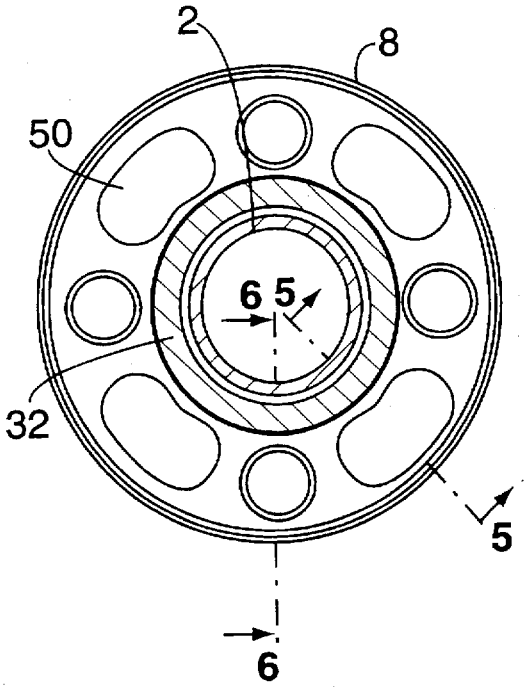
FIG. 3 shows the cross-section of the gas-blast switch along III—III as shown in FIG. 1.

In the following, the quenching gas flow conditions which occur for various switch operation cases will be explained, on the basis of FIGS. 2 to 5. The bottom of the guide piece 32 contains an end disk 42 with at least one valve 43 (FIGS. 2 and 4). The valve 43 comprises guide pins 45 acted on by springs.

The filler element 10 and the axially movable compression piston 9 form a unit which can slide on the guide piece 32 (FIG. 1) in the axial direction, gas-tight with regard to the compression cylinder 8, and contain at least one valve 50 (FIGS. 3 and 5) (illustrations enlarged in each instance).

In a cut-off process of a load current without sufficient excitation of the stator 26 to move the armature, the lids 52, 53 of the valves 43, 50 are closed before the beginning of the movement. The guide pins 45 of the valve 43 press against the lids 53 of the valve 50. After the beginning of movement, the valve 50 closes off the volume V2 to prevent overflow of quenching gas from the volume V2 into the volume V1, by means of a built-in spring 54. Accordingly, quenching gas is compressed in the volume V2, while the volume V1, which is to be increased, fills via the valve 43.

In the case of a break current or a short-circuit current, as explained above, the compression chamber 30 has already been reduced in size before the beginning of movement of the compression device 14, and a corresponding pressure has been built up in the volume V1 via the overflow pipe 31. Both valves 43 and 50 remain closed because of the pressure in the volume V1 on their lids 52 and 53 (the lid 53 rests against the surface 55), and the axially movable compression piston 9 is moved forward counter to the reset force of the spring 34, as described above, reducing the volume V2. After interruption of the break current or short-circuit current, the armature 20 is pushed back into a rest position by the spring 25, and latched in place there, if necessary. The catch is only released again by the drive fork 6 when the cut-in position 16 has been reached, in order to prevent a pressure build-up, which would make the cut-in movement more difficult, from occurring via the compression chamber 24 in case of cut-in in response to a short-circuit.

When the gas-blast switch is switched on, the valve 43 is closed. The pressure built up in the volume V1 opens the valve 50 counter to the closing force of its springs, so that quenching gas can overflow from the decreasing volume V1 to the volume V2, which is increasing during the cut-in process. The valve 50 is only brought into its closing position when the cut-in position 16 has been reached, for example by the guide pins 45 of the valve 43, counter to the force of the spring 54.

I claim:

1. An electrical gas-blast switch comprising:

at least one fixed contact piece;

a movable switching piece;

a compression device including a compression piston and a compression cylinder, the compression piston and the compression cylinder forming a compression space;

an armature;

a stator arranged for moving the armature into a cut-in position of the compression device via a magnetic field; and a drive piston defining a compression chamber, the drive piston being mechanically coupled with the armature, wherein a first side of the compression piston is arranged opposite to the compression space, the compression chamber having a compression chamber pressure acting on the first side of the compression piston so that an increase in the compression chamber pressure causes the compression piston to move toward the compression cylinder.

2. The gas-blast switch according to claim 1, wherein the switching piece is moved by a drive.

3. The gas-blast switch according to claim 1, wherein at least one of the compression piston and the compression cylinder is moved by a drive during a cut-off process, the compression cylinder being moved from the cut-in position to reduce the compression space.

4. The gas-blast switch according to claim 1, wherein the armature is axially moved by the magnetic field of the stator, the stator being excited by a break current.

5. The gas-blast switch according to claim 1, wherein the stator is a coil.

6. The gas-blast switch according to claim 5, wherein the coil includes a segment, the segment including a wall having a radial slit, the radial slit being wound as a screw passing through the wall.

7. The gas-blast switch according to claim 1, wherein the stator is formed from a connector piece.

* * * * *